US008757171B2

(12) United States Patent
Goff et al.

(10) Patent No.: US 8,757,171 B2
(45) Date of Patent: Jun. 24, 2014

(54) FINGER POSITIONING DEVICE FOR A PRINTER

(75) Inventors: Christopher L. Goff, Redondo Beach, CA (US); Joy Bums, Redondo Beach, CA (US); Paul King, Newbury Park, CA (US); Tom Lee Tai To, Kowloon (HK); Catherine Wong Ki Wai, Ap Lei Chau (HK); Chan Wai Keung, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 522 days.

(21) Appl. No.: 12/899,294

(22) Filed: Oct. 6, 2010

(65) Prior Publication Data

US 2011/0108047 A1 May 12, 2011

Related U.S. Application Data

(60) Provisional application No. 61/249,196, filed on Oct. 6, 2009.

(51) Int. Cl.
*A45D 29/22* (2006.01)
*A45D 29/00* (2006.01)

(52) U.S. Cl.
CPC ..... *A45D 29/22* (2013.01); *A45D 29/00* (2013.01)
USPC ..... 132/73; 101/35

(58) Field of Classification Search
USPC ..... 132/73, 200; 347/2, 104, 105
See application file for complete search history.

(56) References Cited

U.S. PATENT DOCUMENTS

| | | | | |
|---|---|---|---|---|
| 3,898,357 | A | 8/1975 | Miller et al. | |
| 4,436,684 | A | 3/1984 | White | |
| 4,440,078 | A | 4/1984 | McCrery et al. | |
| 4,469,022 | A | 9/1984 | Meador | |
| 4,548,825 | A | 10/1985 | Voss et al. | |
| 4,575,805 | A | 3/1986 | Moermann et al. | |
| 4,611,246 | A | 9/1986 | Nihei | |
| 4,611,288 | A | 9/1986 | Duret et al. | |
| 4,742,464 | A | 5/1988 | Duret et al. | |
| 4,843,958 | A | 7/1989 | Egosi | |
| 4,910,661 | A | 3/1990 | Barth et al. | |
| 4,949,283 | A | 8/1990 | Yamauchi et al. | |
| 4,974,610 | A | 12/1990 | Orsini | |
| 4,981,487 | A | 1/1991 | da Costa | |
| 5,079,639 | A | 1/1992 | Mochinaga | |
| 5,302,224 | A * | 4/1994 | Jenkins et al. | 156/230 |
| 5,309,365 | A | 5/1994 | Sullivan et al. | |
| 5,376,956 | A | 12/1994 | Nagao et al. | |

(Continued)

FOREIGN PATENT DOCUMENTS

| | | |
|---|---|---|
| CA | 2270650 | 7/2000 |
| CN | 2171244 | 7/1994 |

(Continued)

*Primary Examiner* — Robyn Doan
(74) *Attorney, Agent, or Firm* — Kolisch Hartwell, PC

(57) ABSTRACT

A finger positioning device for a printer is provided, having a frame, a finger support supported by the frame, the finger support having a loading position and a printing position; and a release latch adjacent the finger support, wherein the finger support is biased to the printing position and the release latch is configured to releasably retain the finger support in the loading position. The finger positioning device may further be configured such that the release latch is triggered to release the finger support from the loading position to the printing position by the distal end of a finger fully introduced onto the finger support.

18 Claims, 3 Drawing Sheets

(56) References Cited

U.S. PATENT DOCUMENTS

| | | | | |
|---|---|---|---|---|
| 5,505,775 | A | 4/1996 | Kitos | |
| 5,724,999 | A | 3/1998 | Kim | |
| 5,782,249 | A | 7/1998 | Weber et al. | |
| 5,931,166 | A | 8/1999 | Weber et al. | |
| 5,954,808 | A | 9/1999 | Paul | |
| 5,975,087 | A | 11/1999 | Jang | |
| 5,988,179 | A | 11/1999 | Jenkins et al. | |
| 6,009,480 | A | 12/1999 | Pleso | |
| 6,024,099 | A | 2/2000 | Jenkins et al. | |
| 6,029,673 | A | 2/2000 | Jenkins et al. | |
| 6,035,860 | A | 3/2000 | Mombourquette | |
| 6,042,881 | A | 3/2000 | Ewan | |
| 6,065,969 | A | 5/2000 | Rifkin et al. | |
| 6,067,996 | A | 5/2000 | Weber et al. | |
| 6,085,757 | A | 7/2000 | Jenkins et al. | |
| 6,148,354 | A | 11/2000 | Ban et al. | |
| 6,189,541 | B1 | 2/2001 | Jenkins et al. | |
| 6,206,009 | B1 | 3/2001 | Paxson | |
| 6,263,762 | B1 | 7/2001 | Zeitler | |
| 6,286,517 | B1 | 9/2001 | Weber et al. | |
| 6,312,124 | B1 | 11/2001 | Desormeaux | |
| 6,318,377 | B1 | 11/2001 | Folks et al. | |
| 6,336,694 | B1 | 1/2002 | Ishizaka | |
| 6,341,831 | B1 | 1/2002 | Weber et al. | |
| 6,363,943 | B1 | 4/2002 | Jenkins et al. | |
| 6,488,371 | B2 | 12/2002 | Kosaka et al. | |
| 6,525,724 | B1 | 2/2003 | Takami | |
| D497,454 | S | 10/2004 | Lin | |
| 6,898,653 | B2 | 5/2005 | Su et al. | |
| 7,046,862 | B2 | 5/2006 | Ishizaka et al. | |
| 7,068,308 | B2 | 6/2006 | Feldis, III | |
| 7,123,983 | B2 | 10/2006 | Yogo et al. | |
| 7,155,069 | B2 | 12/2006 | Ishizaka | |
| 7,233,890 | B2 | 6/2007 | Shapiro et al. | |
| 7,290,550 | B2 * | 11/2007 | Sim | 132/73 |
| 7,434,900 | B2 | 10/2008 | Slomianny et al. | |
| 2002/0097259 | A1 | 7/2002 | Marshall et al. | |
| 2003/0217758 | A1 | 11/2003 | Mesirow | |
| 2004/0194648 | A1 * | 10/2004 | Uchida | 101/35 |
| 2005/0061890 | A1 | 3/2005 | Hinckley | |
| 2005/0150508 | A1 | 7/2005 | Downs et al. | |
| 2005/0174367 | A1 | 8/2005 | Kondo et al. | |
| 2009/0153604 | A1 * | 6/2009 | Chen et al. | 347/9 |

FOREIGN PATENT DOCUMENTS

| | | | |
|---|---|---|---|
| CN | 2532978 | | 1/2003 |
| CN | 1414523 | | 4/2003 |
| CN | 1417745 | | 5/2003 |
| CN | 2550174 | | 5/2003 |
| CN | 1487479 | | 4/2004 |
| CN | 2717694 | | 8/2005 |
| CN | 2720877 | | 8/2005 |
| CN | 1806713 | | 7/2006 |
| CN | 1818403 | | 8/2006 |
| CN | 2838369 | | 11/2006 |
| CN | 2855746 | | 1/2007 |
| CN | 1932881 | | 3/2007 |
| CN | 2888975 | | 4/2007 |
| CN | 2909927 | | 6/2007 |
| CN | 101053467 | | 10/2007 |
| CN | 101095563 | | 1/2008 |
| CN | 201009525 | | 1/2008 |
| CN | 201045932 | | 4/2008 |
| EP | 0006395 | | 1/1980 |
| EP | 0679759 | | 11/1995 |
| EP | 1433597 | | 6/2004 |
| EP | 1204340 | | 3/2005 |
| JP | 04200503 | | 7/1992 |
| JP | 05293955 | | 11/1993 |
| JP | 06155729 | | 6/1994 |
| JP | 08239128 | A * | 9/1996 |
| JP | 11056452 | | 3/1999 |
| JP | 2000006384 | | 1/2000 |
| JP | 2000194838 | | 7/2000 |
| JP | 2000194838 | A * | 7/2000 |
| JP | 2000301778 | | 10/2000 |
| JP | 2000325136 | | 11/2000 |
| JP | 2001002531 | | 1/2001 |
| JP | 2001314226 | | 11/2001 |
| JP | 2002165632 | | 6/2002 |
| JP | 2002307667 | | 10/2002 |
| JP | 2003009938 | | 1/2003 |
| JP | 2004154944 | | 6/2004 |
| JP | 2004160971 | | 6/2004 |
| JP | 2004216872 | | 8/2004 |
| JP | 3615689 | | 2/2005 |
| JP | 2006130052 | | 5/2006 |
| JP | 2006223599 | | 8/2006 |
| JP | 2006224637 | | 8/2006 |
| JP | 2006337967 | | 12/2006 |
| JP | 2007062062 | | 3/2007 |
| JP | 2008073502 | | 4/2008 |
| KR | 20050051608 | | 6/2005 |
| NL | 1011630 | | 6/1999 |
| TW | 412404 | | 11/2000 |
| TW | 576151 | | 2/2004 |
| TW | M256108 | | 2/2005 |
| WO | 9933372 | | 7/1999 |
| WO | 2005120285 | | 12/2005 |
| WO | 2006122451 | | 11/2006 |
| WO | 2007076683 | | 7/2007 |

* cited by examiner

FINGER POSITIONING DEVICE FOR A PRINTER

CROSS-REFERENCES TO RELATED APPLICATIONS

This application claims priority to U.S. Provisional Patent Application Ser. No. 61/249,196, filed Oct. 6, 2009 and entitled FINGER HOLDER FOR FINGERNAIL PRINTER, which is incorporated herein by reference in its entirety for all purposes.

BACKGROUND

Children and adults alike enjoy having colored and/or decorated fingernails. Application of fingernail coloring and/or design by hand, however, can be time consuming and/or costly, especially when done by a professional at a nail salon. Even when done by a professional, the fingernail coloring and/or decoration may not achieve the level of detail or accuracy desired. A fingernail printing device is able to print highly detailed images on small surfaces, such as a fingernail, provided those small surfaces are in a proper printing location and substantially stationary.

The present disclosure is directed to a finger holder for use in conjunction with a fingernail printing device. Examples of finger holders and/or fingernail printing devices are disclosed in U.S. Pat. No. 5,931,166; U.S. Pat. No. 6,035,860; U.S. Pat. No. 6,067,996; U.S. Pat. No. 6,286,517; U.S. Pat. No. 6,336,694; U.S. Pat. No. 7,290,550; and U.S. D497,454. The complete disclosures of the above patents and/or patent applications are herein incorporated by reference for all purposes.

SUMMARY

A finger positioning device for a printer is provided, having a frame, a finger support supported by the frame, the finger support having a loading position and a printing position; and a release latch adjacent the finger support, wherein the finger support is biased to the printing position and the release latch is configured to releasably retain the finger support in the loading position. The finger positioning device may further be configured such that the release latch is triggered to release the finger support from the loading position to the printing position by the distal end of a finger fully introduced onto the finger support.

Also in accordance with the present disclosure, a finger positioning device for a printer is provided having a frame, a finger support supported by the frame, the finger support having a front end and a far end; and a release latch adjacent the far end of the finger support, wherein the release latch is configured to releasably retain the finger support in a loading position and the frame is configured to releasably retain the finger support in a printing position. The frame may further include an aperture through which the finger support moveably extends.

Also in accordance with the present disclosure, a printer for decorating a finger is provided including a housing having an opening on a face of the housing at least as large as a finger, a print head within the housing and configured to apply decoration to a finger, a finger support within the housing having a loading position and a printing position, wherein the platform is biased to the printing position; and a release latch adjacent the finger support and distal the opening, the release latch configured to releasably retain the finger support in the loading position. The finger support may be disposed between the opening and the release latch and/or may be vertically movable with respect to the opening.

The advantages of the present invention will be understood more readily after a consideration of the drawings and the Detailed Description.

DETAILED DESCRIPTION

A finger positioning device in accordance with the present disclosure may securely and releasably retain a finger inside a fingernail printer. The device retains a finger that has been fully inserted in the finger positioning device. A user may easily insert and remove a finger from the finger positioning device. While the device may be used in any fingernail decorating device, it works particularly well inside a printer, allowing the printer to accurately print on a user's fingernail when a finger is inserted.

Figure 1:
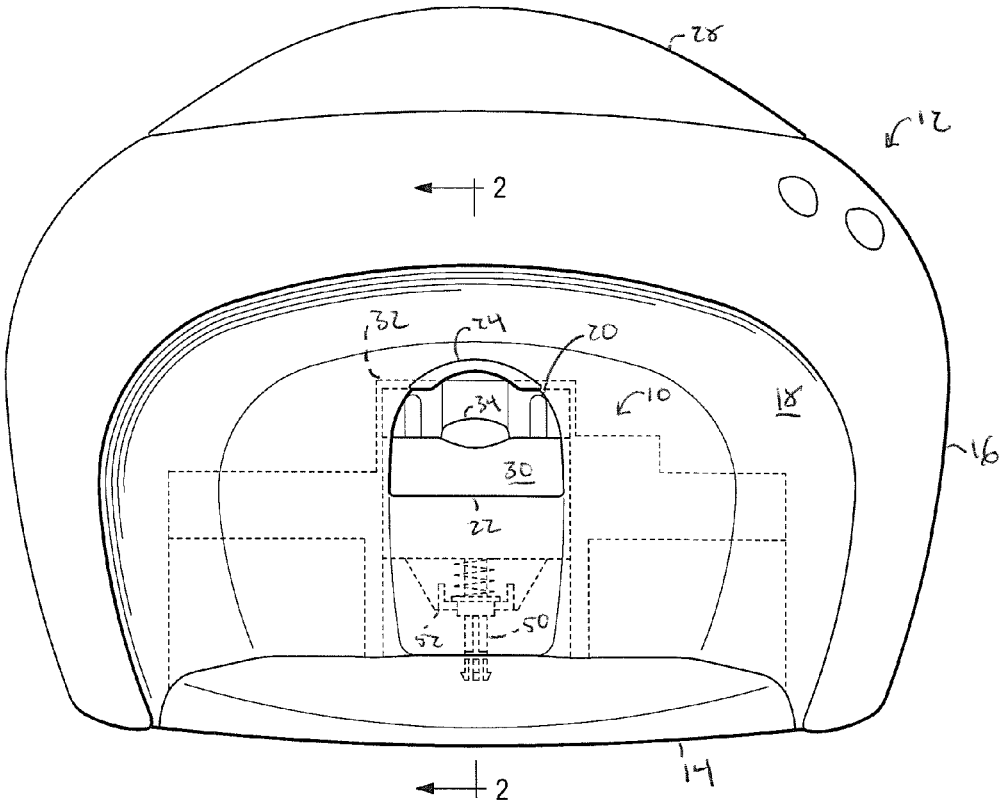
FIG. 1 is a front view partial view of a finger positioning device within a fingernail printer, the finger positioning device including a finger support in accordance with the present disclosure.

FIGS. 1-5 show an embodiment of a finger positioning device, indicated generally at 10, for a printer 12. As shown in FIG. 1, printer 12 may include a platform 14 and a housing 16 having a concave front face 18 and an opening 20. A portion of finger positioning device 10 is visible through opening 20, and other parts of finger positioning device 10 are shown in relief behind front face 18.

Opening 20 may be at least as large as a human finger and may have curved or blunt peripheral edges. A lower edge 22 of opening 20 may be spaced from platform 14 such that the other, not-inserted, fingers and/or thumb may dangle or move freely. A top portion of opening 20, or an upper finger barrier 24, may project inwardly and may serve as an upper limit of movement for an inserted finger, as seen best in FIG. 3. Fingernail decorating means, such as an ink-jet printer, also referred to as a print head 26, or other fingernail decorating means known to those skilled in the art, may be disposed above upper finger barrier 24. Printer 12 may further include a lid 28 that may be hingedly connected to a rear portion of housing 16.

Finger positioning device 10 may be disposed adjacent face 18 of printer 12 and/or opening 20. Finger positioning device 10 may include a finger support 30, a frame 32 and/or a release latch 34. Finger support 30 may include a platform or top surface 36 spanning at least the width of opening 20 and/or including a finger indentation 38, the length of which may be at least as long as a child's fingernail. Finger support 30 may include a front wall 40 adjacent opening 20 and a rear wall 42 on a distal side of finger support 30. As shown in FIG.

5, rear wall 42 may include one or more sliding members 44 configured to slidingly engage one or more apertures 46 extending a length of frame 32.

Figure 3:
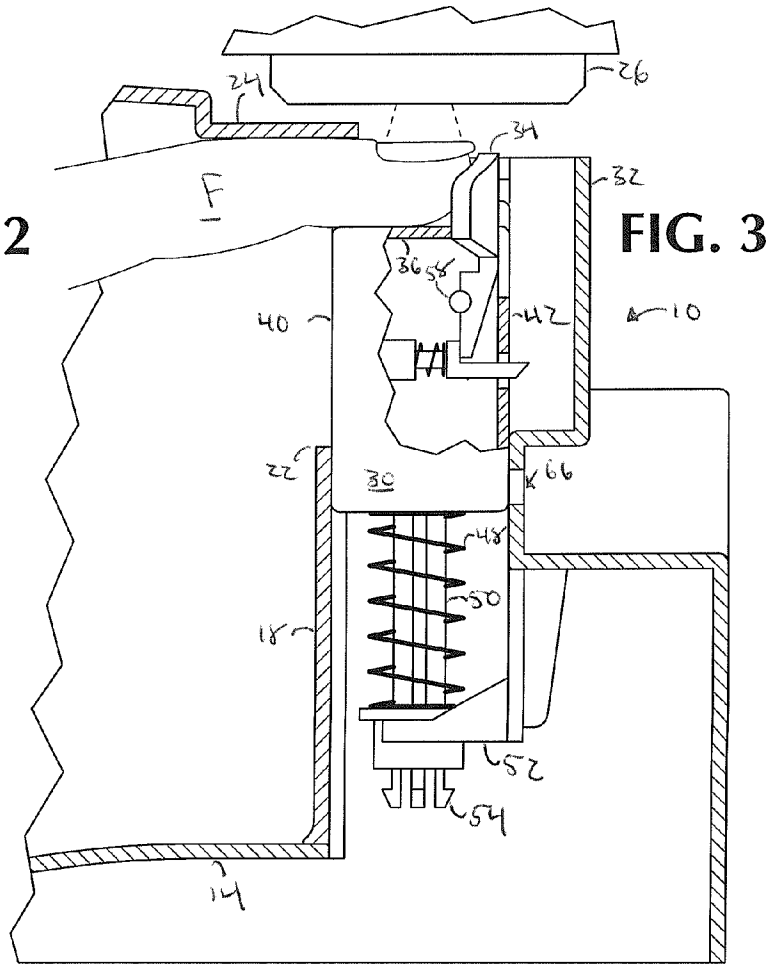
FIG. 3 is a cross-sectional view of the finger positioning device of FIG. 1, taken generally along the line 2-2 in FIG. 1, showing the finger support in a printing position in accordance with the present disclosure.
Figure 2:
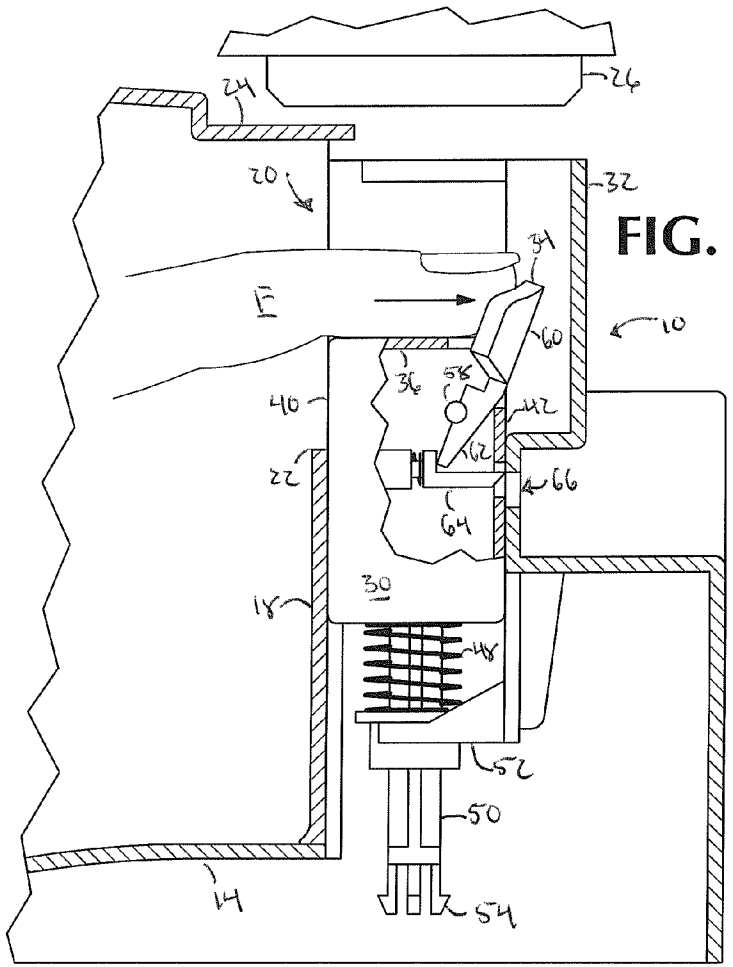
FIG. 2, is a cross-sectional view of the finger positioning device of FIG. 1, taken generally along the line 2-2 in FIG. 1, showing the finger support in a loading position in accordance with the present disclosure.
Figure 5:
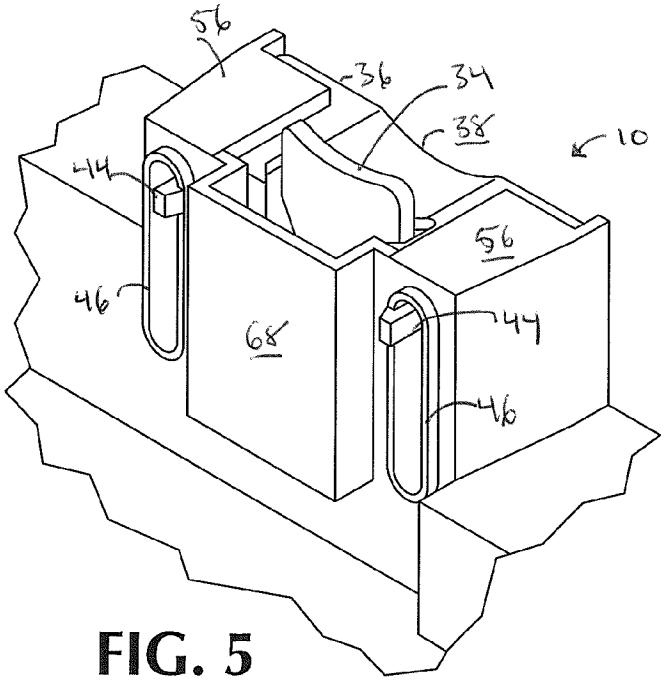
FIG. 5 is a rear perspective view of the finger positioning device of FIG. 1, showing the finger support in a printing position in accordance with the present disclosure.
Figure 4:
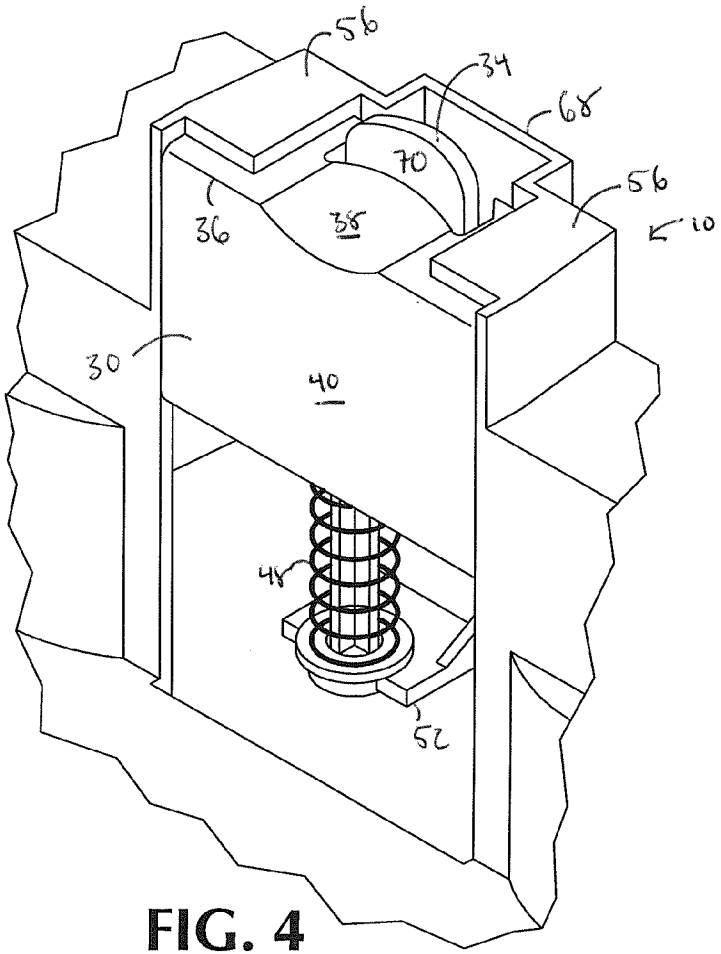
FIG. 4 is a front perspective view of the finger positioning device of FIG. 1, showing the finger support in a printing position in accordance with the present disclosure.

Finger support 30 may be movable between at least a first position and a second position and may include a biasing member, such as a spring 48, such that finger support 30 is biased to the second position. The first position may also be referred to as the loading position and is shown in FIGS. 1 and 2, and the second position may be referred to as the printing position and, as shown in FIGS. 3-5, may be elevated with respect to the loading position. FIGS. 3 and 4 show spring 48 and finger support 30 in the printing position, wherein spring 48 is at least partially extended, and FIGS. 1 and 2 show spring 48 in the loading position, wherein spring 48 is at least partially compressed. Spring 48 may be coiled around a bias support member 50 extending from finger support 30.

Finger positioning device 10 may be configured such that finger support 30 moves from the loading position to the printing position when a finger is fully inserted into finger positioning device 10. In other words, finger positioning device 10 may be configured such that finger support 30 is released from the loading position to the printing position by the distal end of a finger fully introduced onto finger support 30. As shown in FIGS. 1 and 2, in the loading position, opening 20 is sufficiently open such that a user may insert a finger F into opening 20 and onto finger support 30. In the printing position, finger support 30 may be elevated or raised with respect to the loading position and opening 20 may be substantially blocked by front wall 40 of the raised finger support 30. As shown in FIG. 3, finger F resting on finger support 30 in the printing position may be fully inserted into finger positioning device 10 such that a fingernail is disposed under the print head 26 and is ready to receive color and/or design from print head 26.

Finger support 30 may be supported by frame 32 and/or housing 12. For example, frame 32 may provide support to bias support member 50. Additionally and/or alternatively, frame 32 may releasably retain finger support 30 in the printing position. For example, bias support member 50 may slidingly engage a bias aperture 52 at the bottom of frame 32. The diameter of the distal end of bias support member 50 of finger support 30 may be larger than the diameter of bias aperture 52. For example, the distal end of bias support member 50 may include one or more teeth 54 configured to contact the underside of bias aperture 52 when bias support member 50 is in the printing position, such that bias support member 50 does not disengage or come out of bias aperture 52. Additionally and/or alternatively, as shown in FIGS. 4 and 5, arms 44 may meet the upper limit of elongate apertures 46 when finger support 30 is in the printing position and/or top surface 36 may meet retaining walls 56 when finger support 30 is in the printing position. Accordingly, finger support 30 and/or spring 48 may be prevented from extending beyond the printing position by frame 32.

Turning now to FIGS. 2 and 3, release latch 34 may be configured to releasably retain finger support 30 in the loading position. In some embodiments, release latch 34 may be triggered release finger support 30 from the loading position to the printing position by the distal end of a finger fully introduced onto finger support 30. For example, release latch 34 may be adjacent the end of finger support 30 distal from opening 20, also referred to as the far end of finger support 30 and/or release latch 34 may be disposed between finger support 30 and frame 32.

Release latch 34 may be pivotally connected to finger support 30 about a pivot point 58 such that an upper portion 60 of release latch 34 may extend above top surface 36 of finger support 30 and a lower portion 62 of release latch 34 may extend below top surface 36 of finger support 30. Upper portion 60 may be pivotable away from the distal end of finger support 30. Lower portion 62 of release latch 34 may include a moveable release arm 64 configured to releasably/removably engage a portion of frame 32, for example a release aperture 66, also referred to as a latch aperture, in the rear frame wall, such that biased finger support 30 is releasably retained in the loading position (FIG. 2). FIG. 3 shows finger support 30 in the printing position, wherein release arm 64 is not engaged with release aperture 66 and/or frame 32.

Upper portion 60 of release latch 34 may include a contact area 70 having a concave shape at the end of finger indentation 38, distal opening 20. Pivotal movement of upper portion 60 towards rear frame wall 68 and the lower portion away from rear frame wall 68 may remove release arm 64 from engagement with release aperture 66 and subsequently finger support 30 may be released to the printing position. Release latch 34 may be biased to pivotally return upper portion 60 towards the distal end of finger indentation 38. Release latch 34 may be configured such that finger F inserted into finger positioning device 10 will only engage or trigger contact area 70 when finger F is fully inserted into finger positioning device 10.

In operation of finger positioning device 10, finger support 30 starts in the loading position. In the loading position, at least a portion of opening 20 is open or not blocked by front wall 40 and a user may insert a finger in opening 20 and onto top surface 36. When a finger is fully inserted, the far tip of a finger may push against contact area 70 of release latch 34. Upper portion 60 of release latch 34 may move towards rear frame wall 68 and lower portion 62 may move away from rear frame wall 68, such that release arm 64 and release aperture 66 disengage.

Finger support 30 and the inserted finger may then be biased upwards to the fingernail printing position. An upper surface of a finger may contact upper finger barrier 24 of opening 20 such that a finger is securely positioned between upper finger barrier 24 and top surface 36. Alternatively, finger positioning device 10 may include a finger stop. Finger indentation 38 may limit lateral movement of a finger with respect to face 18 of printer 12. Print head 26 may then print on a fingernail.

A user may remove a finger by pulling it out of finger positioning device 10 and/or by depressing finger support 30 down to the loading position, such that release arm 64 of release latch 34 re-engages release aperture 66. Once release arm 64 re-engages release aperture 66, finger support 30 may be retained in the loading position.

Some embodiments of the printer may operate in conjunction with a computer having fingernail printing software. A user may install the software using a USB cable. The software may permit a user to design the image to be printed. A digital imager may be used to allow a user to see the active area of the finger support. A user may insert a finger in the finger positioning device as described above, such that a finger has been inserted into the proper location on the finger support. An operating button on the printer may cause the digital imager to take a photograph of the active area of the finger support. On screen graphics may show that a picture has been taken, and the picture stays on-screen so that it is not necessary to keep a user's finger inserted in the fingernail printer, while a user selects a design to apply to a finger.

The photograph may stay on the computer screen while a user may now use the computer to choose the design that will be applied to a finger. A template may be stretched or reduced to fit a fingernail shown in the photograph. The photograph may stay on screen, and the properly sized template may become invisible. A user may then scroll through a broad range of images, or even import photographs. For example, a user may select a "Flower Power" group of pre-defined images. A simulated drawer may be opened on screen, showing possible flower-related designs.

Any selection of a design may be represented in the center of the photograph of a user's finger. Preferably, the selected design may automatically crop at the boundary of the properly sized, now-invisible template. The selected design may be enlarged, reduced and/or rotated on screen. Once a user is happy with the design, the photograph may be removed, and a live image of the finger support may be shown, with the selected design superimposed over the proper printing area. A user may now re-insert her finger into the proper printing area, and a finger will show on screen. A user may move her finger within the proper printing area, and then push one of the buttons on the printer with her other hand. Graphics on screen may tell a user that the printer is operating. The above described procedure may be used with any image, including photographs a user imports from other devices or software.

The various embodiments of the illustrated finger positioning device, and the various components may be fabricated from any suitable material, or combination of materials, such as plastic, foamed plastic, wood, cardboard, pressed paper, metal, or the like. A suitable material may be selected to provide a desirable combination of weight, strength, durability, flexibility, cost, manufacturability, appearance, safety, and the like.

Although the present invention has been shown and described with reference to the foregoing operational principles and preferred embodiments, it will be apparent to those skilled in the art that various changes in form and detail may be made without departing from the spirit and scope of the invention. The present invention is intended to embrace all such alternatives, modifications and variances that fall within the scope of the appended claims.

We claim:

1. A finger positioning device for a printer comprising:

a frame;

a finger support supported by the frame, the finger support having a loading position and a printing position, the finger support being biased by a spring to the printing position; and a release latch adjacent the finger support, the release latch being configured to releasably retain the finger support in the loading position with the spring at least partially compressed, and the release latch being configured to release the finger support to the printing position when a finger is fully inserted into the finger positioning device, with the spring at least partially extended.

2. The finger positioning device of claim 1, wherein the release latch is triggered to release the finger support from the loading position to the printing position by a distal end of a finger fully introduced onto the finger support.

3. The finger positioning device of claim 1, wherein the release latch is adjacent a distal end of the finger support.

4. The finger positioning device of claim 1, wherein the release latch is removably engaged with the frame in the loading position.

5. A finger positioning device for a printer comprising:

a frame;

a finger support supported by the frame, the finger support having a front end and a far end opposite the front end; and a release latch adjacent the far end of the finger support;

wherein the release latch is configured to releasably retain the finger support in a loading position and the frame is configured to releasably retain the finger support in a printing position;

wherein the release latch is triggered to release the finger support to the printing position when a finger is fully inserted into the finger positioning device so that the finger contacts the far end of the finger support.

6. The finger positioning device of claim 5, wherein the frame includes an aperture through which the finger support moveably extends.

7. The finger positioning device of claim 6, wherein the diameter of a distal end of the finger support is larger than the diameter of the aperture.

8. The finger positioning device of claim 5, wherein the release latch is pivotally joined to the far end of the finger support.

9. The finger positioning device of claim 5, wherein the frame includes a latch aperture.

10. The finger positioning device of claim 5, wherein the frame includes an elongated aperture and the finger support is slidably engaged with the elongated aperture.

11. A finger positioning device for a printer comprising:

a frame;

a finger support supported by the frame, the finger support having a front end and a far end; and a release latch adjacent the far end of the finger support;

wherein the release latch is configured to releasably retain the finger support in a loading position and the frame is configured to releasably retain the finger support in a printing position, wherein the release latch is pivotally joined to the far end of the finger support, and wherein the release latch includes an upper portion extending above the finger support and a lower portion extending below the finger support, wherein the lower portion is removably engaged with the frame when the finger support is in the loading position.

12. A printer for decorating a finger comprising:

a housing having an opening on a face of the housing at least as large as a finger;

a print head within the housing and configured to apply decoration to a finger;

a finger support supported by a frame within the housing, the finger support having a platform, a loading position, and a printing position, wherein the platform is biased to the printing position; and a release latch adjacent the finger support and distal the opening, the release latch being configured to releasably retain the finger support in the loading position, wherein the release latch is removably engaged with the frame when the finger support is in the loading position.

13. The apparatus of claim 12, wherein the finger support is disposed between the opening and the release latch.

14. The apparatus of claim 12, wherein the finger support is vertically movable with respect to the opening.

15. The apparatus of claim 14, wherein a front face of the finger support substantially blocks the opening in the printing position.

16. The apparatus of claim 12, wherein an upper portion of the release latch extends above a distal end of the finger support and is pivotable away from the distal end of the platform.

17. The apparatus of claim 13, wherein the release latch is disposed between the finger support and the frame.

18. The apparatus of claim 17, wherein the frame releasably retains the finger support in the printing position.

* * * * *